US005485821A

United States Patent [19]

Yoshizawa

[11] Patent Number: 5,485,821

[45] Date of Patent: Jan. 23, 1996

[54] ENGINE FUEL INJECTION CONTROLLER

[75] Inventor: Kodai Yoshizawa, Yokohama, Japan

[73] Assignee: Nissan Motor Co., Ltd., Yokohama, Japan

[21] Appl. No.: 306,621

[22] Filed: Sep. 15, 1994

[30] Foreign Application Priority Data

Sep. 22, 1993 [JP] Japan ..... 5-236375

[51] Int. Cl.[6] ..... F02M 51/00

[52] U.S. Cl. ..... 123/478

[58] Field of Search ..... 123/480, 478, 123/425, 491; 364/431.05

[56] References Cited

U.S. PATENT DOCUMENTS

| | | | |
|---|---|---|---|
| 5,284,116 | 2/1994 | Richeson, Jr. | 123/425 |
| 5,331,936 | 7/1994 | Messih et al. | 123/480 |
| 5,367,462 | 11/1994 | Klenk et al. | 364/431.05 |
| 5,390,641 | 2/1995 | Yamada et al. | 123/491 |

FOREIGN PATENT DOCUMENTS

| | | | |
|---|---|---|---|
| 63-41634 | 2/1988 | Japan | 123/478 |

*Primary Examiner*—Raymond A. Nelli
*Attorney, Agent, or Firm*—Foley & Lardner

[57] ABSTRACT

A fuel delay correction under transient engine running conditions is separated into a short-term delay correction and a long-term delay correction, and the fuel injection amount is corrected by respectively applying these correction according to the engine running conditions. A basic updating amount of these corrections is computed based on the difference between an air-fuel ratio which is actually detected and a target value of the air-fuel ratio, and the basic updating amount is separated into an updating amount for the short-term delay correction and an updating amount for the long-term delay correction by an assignment factor which is based on the temperature of a part of the intake air passage to which injected fuel adheres. The respective correction amount is updated by the assigned updating amount, and stored in a memory. The fuel injection amount is thereby controlled according to the temperature of the part to which fuel adheres, and the air-fuel ratio in transient conditions is controlled to the target air-fuel ratio in a short time period.

8 Claims, 13 Drawing Sheets

ENGINE FUEL INJECTION CONTROLLER

FIELD OF THE INVENTION

This invention relates to an engine fuel injection controller, and more specifically, to a wall flow correction applied to injection amount control during transient running conditions of the engine.

BACKGROUND OF THE INVENTION

In an internal combustion engine provided with a fuel injector, injected fuel is supplied to the cylinder as a spray from an intake port. However, as the fuel is originally in a liquid form, part of it adheres to the intake port or the intake valve, and it therefore enters the cylinder in a different form to that of the air-fuel mixture, so-called wall flow. The time required for fuel in this form to enter the cylinder is different from the time required for fuel in the air-fuel mixture to enter the cylinder, and the wall flow reaches the cylinder later than the fuel in the air-fuel mixture. If the engine is running under steady state conditions, this delay has no effect on the air-fuel ratio in the cylinder. However, under transient running conditions such as during acceleration or deceleration, the air-fuel ratio in the cylinder may fluctuate toward rich or lean with respect to the theoretical (stoichiometric) air-fuel ratio due to the difference in the rate at which the air-fuel mixture and the wall flow reach the cylinder.

More specifically, as some of the extra injected fuel during acceleration becomes wall flow, a delay occurs in the increase of fuel with respect to the increased air flowing into the cylinder, hence the air-fuel ratio shifts to lean. Conversely during deceleration, due to the wall flow, a delay occurs in the decrease of fuel with respect to the decrease of air flowing into the cylinder, hence the air-fuel ratio shifts to rich. Moreover, not all of the fuel particles in the air-fuel mixture flow uniformly into the cylinder and a part of them flows sluggishly along between the injector and the cylinder. These fuel particles are therefore delayed with respect to the air flow.

The actual amount of the delay in the fuel supply due to this fuel adhesion or sluggishness of fuel flow depends on, for example, the structure of the engine, the engine temperature and the structure of the gas flow passage. In this respect, Tokkai Sho 63-41634 published by the Japanese Patent Office discloses an engine fuel injection controller which corrects the fuel injection amount for a short-term, smaller delay having a relatively fast time constant, and a long-term, larger delay having a relatively slow time constant.

In this controller, a correction amount is determined according to the engine running conditions for the short-term delay and long-term delay respectively, the difference between the correction amount and a feedback correction amount determined from a measured air-fuel ratio is calculated, and the difference is learned so as to update the correction amount for both the short-term delay and the long-term delay.

The amount of fuel which is delayed also varies according to the temperature of that part of the intake port where the wall flow forms, and it increases the lower the temperature. The short-term delay which varies with a fast time constant contains elements such as a delay in computing the fuel injection amount which is unrelated to the wall flow, but almost all of the long-term delay which varies with a slow time constant is due to wall flow. This is why the long-term delay largely increases when the temperature of the fuel adhesion area decreases, whereas the short-term delay increases only slightly.

These flow delays also vary according to the nature of the fuel. For example, heavy gasoline has a low volatility so that wall flow forms easily. When the fuel is changed from standard gasoline to heavy gasoline, therefore, although both the short-term and long-term delays increase, it is the long-term delay which shows a particularly large increase.

Hence, by learning separate correction amounts for the short-term and long-term delays as described hereinabove, it is possible to allow for these air-fuel ratio fluctuations with different responses.

In the aforementioned fuel injection controller, the correction amount used in the learning process is stored together with the engine running conditions, i.e. the engine speed and load. However, as the amount of fuel which is delayed varies according to the temperature of the part where wall flow is formed, both of the aforementioned delays will vary if this temperature varies from the time of learning to the time when the learned value is used. In this controller, therefore, there was a problem in that temperature variation of the intake port where the injected fuel adheres lessened the precision of the correction, and in such a case a long time was required before the air-fuel ratio settled at the theoretical air-fuel ratio.

SUMMARY OF THE INVENTION

It is therefore an object of this invention to correct the fuel injection amount in accordance with the temperature variation of the fuel adhesion part of the intake port.

It is a further object of this invention to apply a correction for the aforesaid two types of delay with suitable precision without learning each type of delay separately.

It is yet a further object of this invention to maintain engine running conditions stable when the fuel is changed from standard gasoline to heavy gasoline.

In order to achieve the above objects, this invention provides a fuel injection controller for use with an engine comprising a cylinder, an intake passage provided with a valve that aspirates air into the cylinder, a throttle for regulating the flowrate in the passage, and an injector provided between the throttle and the valve for injecting fuel into the passage according to an input signal.

The controller comprises a mechanism for detecting an engine running condition, a mechanism for calculating a basic fuel injection amount based on the engine running condition, a mechanism for detecting a temperature of a part of the passage to which injected fuel adheres, a mechanism for storing short-term delay correction amounts corresponding to various engine running conditions and temperatures of the aforesaid part, the short-term delay correction amounts compensating for a delayed flow in the passage having a relatively fast time constant, a mechanism for storing long-term delay correction amounts corresponding to various engine running conditions and temperatures of the aforesaid part, the long-term delay correction amounts compensating for a delayed flow in the passage having a relatively slow time constant, a mechanism for reading a short-term delay correction amount from the short-term delay correction amounts storing mechanism corresponding to the detected engine running condition and the detected temperature, a mechanism for reading a long-term delay correction amount from the long-term delay correction amounts storing mechanism corresponding to the detected engine running condition and the detected temperature, a mechanism for correcting the basic fuel injection amount by the read correction amounts, a mechanism for inputting a signal corresponding to the corrected fuel injection amount to the injector, a mechanism for detecting an air-fuel ratio in the cylinder, a mechanism for calculating a basic updating amount based on the difference between the detected air-fuel ratio and a preset target value of the air-fuel ratio, and a mechanism for updating the delay correction amount in each of the storing mechanism based on the basic updating amount and the detected temperature.

The basic updating amount calculating mechanism preferably comprises a mechanism for respectively calculating areas of lean and rich regions of the air-fuel ratio with respect to the target value over a predetermined time interval, each of the areas being equal to the product of the aforesaid difference and the elapsed time, a mechanism for calculating a difference of the areas and a mechanism for calculating the basic updating amount based on the difference of areas.

Alternatively, the basic updating amount calculating mechanism comprises a mechanism for respectively accumulating times for which the detected air-fuel ratio is lean and rich with respect to the target value over a predetermined time interval, a mechanism for calculating a difference of the times, and a mechanism for calculating the basic updating amount based on the difference of times.

The updating mechanism preferably comprises a mechanism for determining a total updating amount which is directly proportional to the basic updating amount, a mechanism for determining a proportion assignment factor of the total updating amount based on the temperature of the aforesaid part, and a mechanism for allocating the total updating amount to an updating amount of the short-term delay correction amount and to an updating amount of the long-term delay correction amount based on the factor.

The factor determining mechanism preferably decreases the proportion assigned to the short-term delay correction updating amount, and increases the proportion assigned to the long-term delay correction updating amount, the lower the temperature of the aforesaid part.

Also, preferably, the factor determining mechanism further comprises a mechanism for forcing the proportion assigned to the long-term delay correction updating amount to always exceed a value preset according to the temperature of the aforesaid part.

The temperature detecting a mechanism preferably comprises a mechanism for detecting a temperature of the valve.

The details as well as other features and advantages of this invention are set forth in the remainder of the specification and are shown in the accompanying drawings.

DESCRIPTION OF THE PREFERRED EMBODIMENTS

Figure 1:
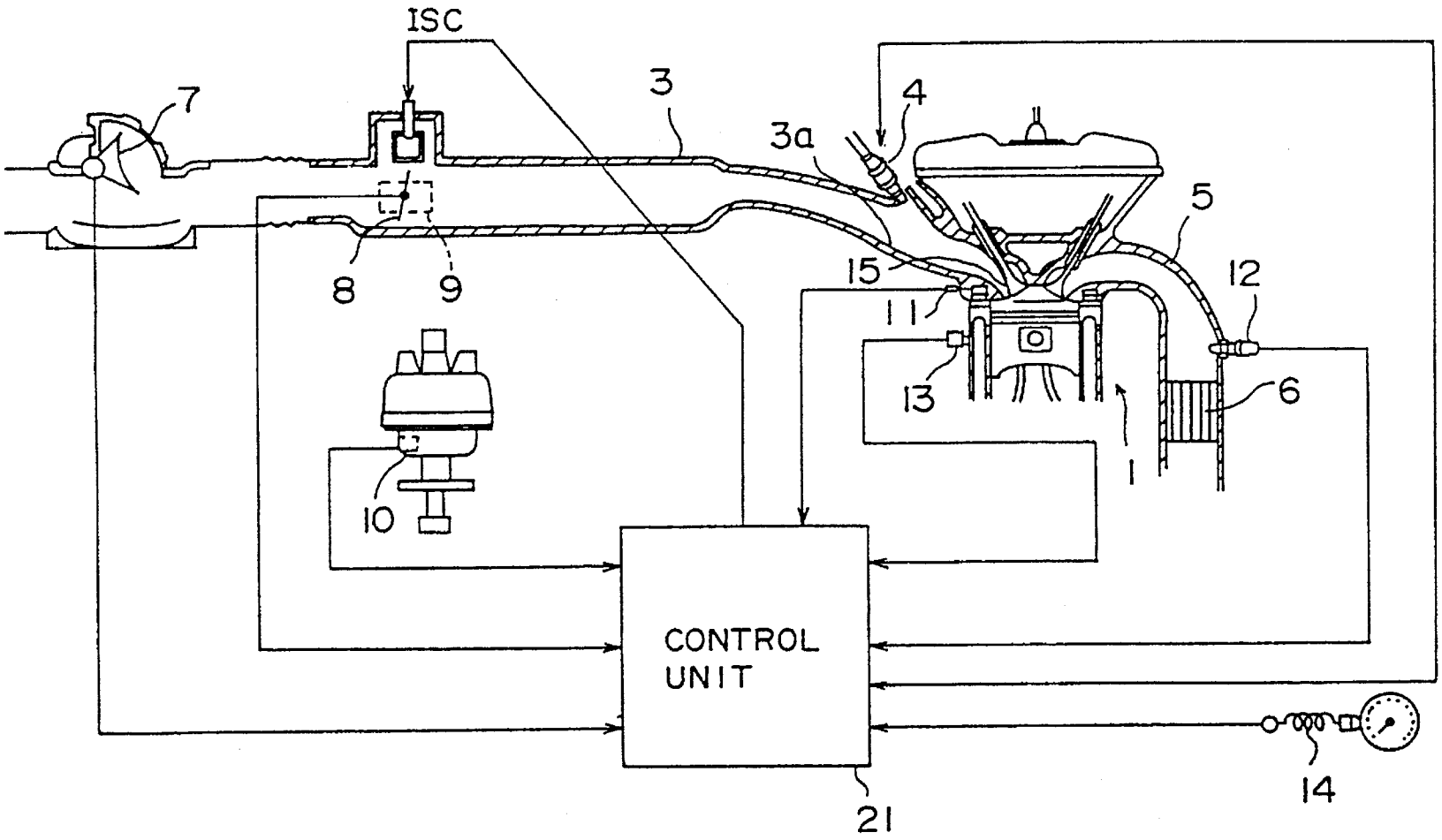
FIG. 1 is a schematic diagram of a fuel injection controller according to a preferred embodiment of the invention.

Referring to FIG. 1 of the drawings which shows a preferred embodiment of the invention, an intake pipe 3 and exhaust pipe 5 are respectively connected to a cylinder 1 of a vehicle engine. An air flow meter 7 for detecting an intake air volume Qa, and a throttle 8 for regulating the amount of intake air, are installed midway along the intake pipe 3. A three-way catalytic converter 6 for converting and cleaning toxic components NOx, CO and HC in the exhaust, and an air-fuel ratio sensor 12 for detecting the real air-fuel ratio in the cylinder 1 over a wide range from the oxygen concentration of the exhaust, are installed midway along the exhaust pipe 5.

Air in the intake pipe 3 is sucked into the cylinder 1 through an intake port 3*a* via an intake valve 15, and fuel is injected into the intake air by an injector 4 at the intake port 3*a* so as to provide a gassy air-fuel mixture to the cylinder 1.

If the fuel injection amount becomes larger with respect to a fixed amount of intake air, the air-fuel ratio of the gas mixture shifts to rich, conversely if the fuel injection amount becomes smaller with respect to a fixed amount of intake air, the air-fuel ratio of the gas mixture shifts to lean. When the air-fuel ratio shifts to rich compared to the theoretical air-fuel ratio, the ability of the converter 6 to oxidize CO and HC declines, conversely when the air-fuel ratio shifts to lean, the ability of the converter 6 to reduce NOx declines. A control unit 21 comprising a microprocesso therefore determines a basic fuel injection amount with respect to the air volume drawn into the cylinder 1 so that the air-fuel ratio is maintained at the theoretical air-fuel ratio. This basic fuel injection amount is calculated as a signal pulse width Tp.

In order to perform the aforementioned air-fuel ratio control, the air flow meter 7, a crank angle sensor 10 which outputs a signal for unit crank angle rotation and outputs a basic crank angle position, a water temperature sensor 13*a* for detecting a cooling water temperature Tw, a pressure sensor 14 for detecting a negative intake pressure $P_B$ a throttle opening sensor 9 for detecting a throttle opening Tvo, and a temperature sensor 11 for detecting a temperature Tb of the intake valve 15, are provided. Signals from these sensors are input to the control unit 21 together with a signal from the air-fuel ratio sensor 12.

The control unit 21 determines a basic injection pulse width $T_p$ based on these signals, and feedback controls the real air-fuel ratio to the theoretical air-fuel ratio based on the signal from the air-fuel ratio sensor 12. The feedback control results are also learned, and learning control is performed so that the fuel injection amount is corrected base on the learned values before feedback control is applied.

The correction amount calculated by learning control is separated into a short-term delay correction Kh having a fast time constant, and a long-term delay correction Kl having a slow time constant. The former correction amount is made in respect of fuel flowing in the gas in the intake port 3*a* from the injector 4 to the cylinder 1, while the latter correction amount is made in respect of fuel adhering to the wall of the intake port 3*a* which is moving slowly. The control unit 21 learns these correction amounts together with the engine speed and the temperature of the intake port 3*a* to which fuel is adhering. These learned values are updated according to the difference between the real air-fuel ratio and the theoretical air-fuel ratio. The updated amounts are then assigned to the short-term delay correction Kh and long-term delay correction Kl by an assignment factor which is based on the temperature of the fuel adhesion part of the intake port 3*a*.

This control process performed by the control unit 21 will now be described with reference to the flowcharts of FIG. 2–4.

Figure 2:
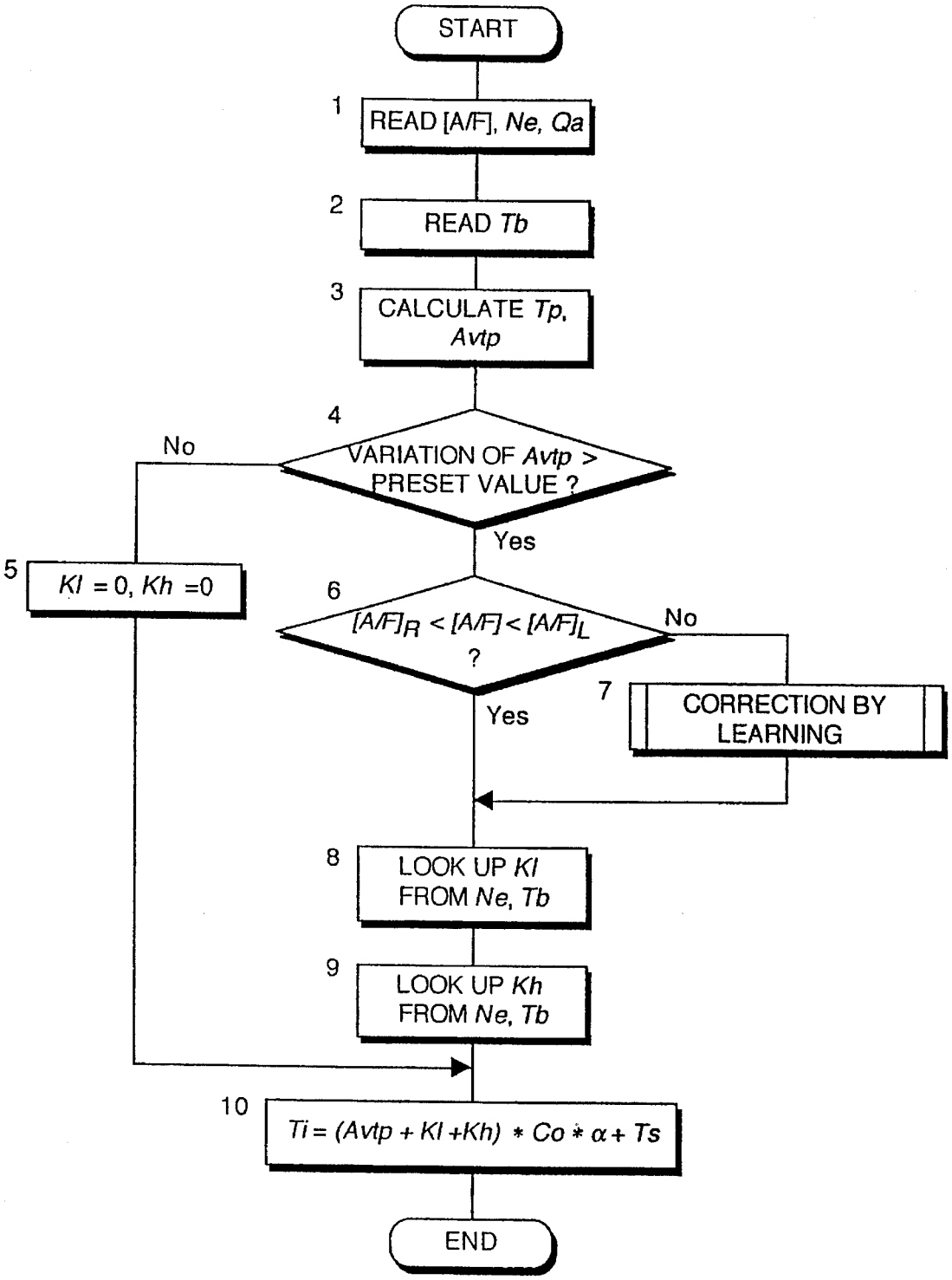
FIG. 2 is a flowchart describing a computation process of a fuel injection pulse width Ti according to this invention.

FIG. 2 shows the process used for computing an injection pulse width Ti. This process is executed at periodic intervals of for example 2 ms.

First, the real air-fuel ratio is read from the output of the air-fuel ratio sensor 12, the engine speed Ne is read from the output of the crank angle sensor 10, and Qa is read from the output of the air flow meter 7 (step 1). The temperature Tb of the intake valve 15 is then read as the temperature of the fuel adhesion part (step 2).

If it is difficult to measure the valve temperature, an equilibrium temperature of the fuel adhesion part may be found based on the cooling water temperature Tw and an intake air temperature Ta, as disclosed in Tokkai Hei 1-305142 published by the Japanese Patent Office, and a temperature prediction value Tf of the fuel adhesion part found as a first order delay of the equilibrium temperature Th.

Further, by suitably choosing an initial value on start-up which approaches the cooling water temperature with a first order delay, the value will show a variation which is close to the temperature variation of the fuel adhesion part. An easier method is then to use the value of Tb found from the following equation as a temperature prediction value of the fuel adhesion part.

$$Tbl=Tbl_{-1sec}+(Tw-Tbl_{-1sec})*Tblh$$

where,

Tbl=temperature prediction value of fuel adhesion part $Tbl_{-1sec}$=Tbl at 1 second before Tw=cooling water temperature Tblh=correction rate Next, a basic injection pulse width Tp and a pulse width Avtp corresponding to the cylinder air volume are found from the following equations (step 3). The fuel injection amount supplied by the injector 4 is basically determined in correspondence with the cylinder air volume, and the basic injection pulse width Tp expressed the fuel injection amount in terms of the pulse width of the injection signal input to the injector 4. Avtp is an injection amount corresponding to the cylinder intake air volume, the variation of this air volume having a delay to that of the measured air volume by the air flow meter.

$$Avtp=Tp*Fload+Avtp_{n-1}*(1-Fload)$$

where, $Avtp_{n-1}$=Avtp on immediately preceding occasion

Fload=weighting average coefficient $$Tp=\frac{Qs}{Ne}*K\#*Ktrm$$

where,

Qs=intake air volume obtained by processing air flow meter output

Ne=engine speed

K#=constant for determining basic air-fuel ratio

Ktrm=constant determined by flow characteristics of injector

All the above equations are known in the prior art.

Next, it is determined whether or not the engine 1 is running under transient conditions. For this purpose, it is determined whether or not the variation of the cylinder air equivalent pulse width Avtp is greater than a predetermined value (step 4). If the variation of Avtp is less than the predetermined value, it is determined that the engine is running under steady state conditions, a correction for delayed flow is not applied, the correction coefficients Kh and Kl are both set to O and the routine proceeds to the calculation of the fuel injection pulse width Ti (steps 5, 10).

$$Ti=(Avtp+Kh+Kl)*Co*\alpha+Ts$$

where,

Avtp=cylinder air equivalent pulse width

Kh=short-term delay correction

Kl=long-term delay correction

Co=sum of 1 and correction coefficients

α=air-fuel ratio feedback correction coefficient

Ts=ineffectual pulse width

Figure 5:
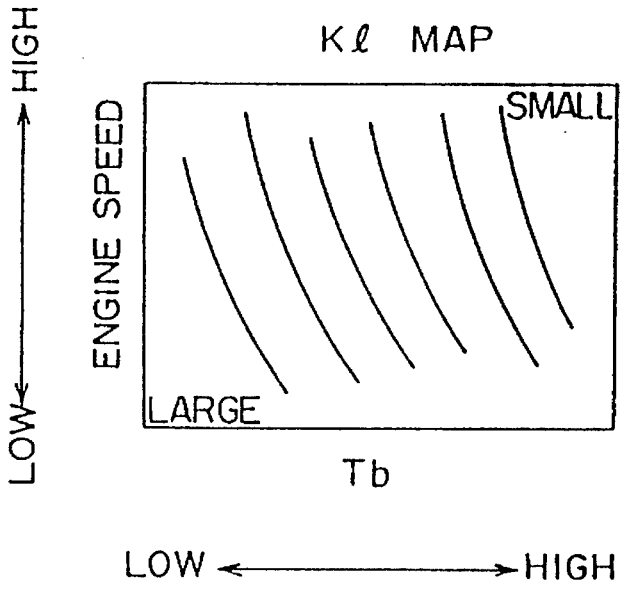
FIG. 5 is a map of the long-term delay correction amount Kl according to this invention.
Figure 6:
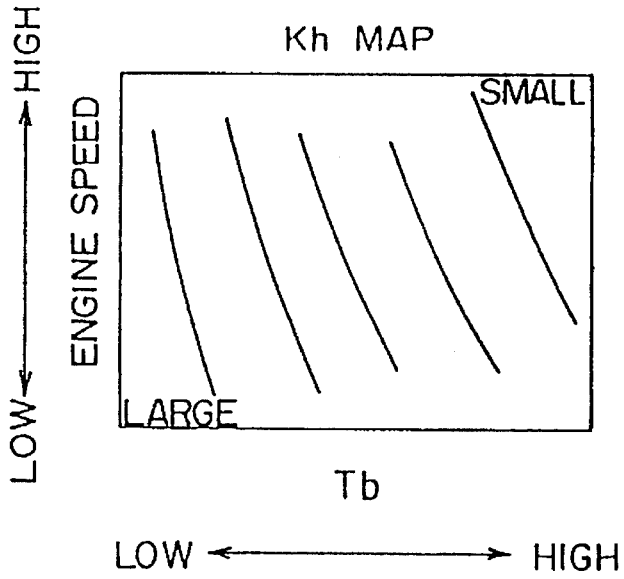
FIG. 6 is a map of the short-term delay correction amount Kh according to this invention.

If on the other hand the variation of Avtp is greater than the predetermined value it is determined that the engine is running under transient conditions, and it is then determined whether or not the air-fuel ratio [A/F] is between a rich limit $[A/F]_R$ and a lean limit $[A/F]_L$. For example, the rich limit $[A/F]_R$ may be set to 13.5 and the lean limit $[A/F]_L$ may be set to 15.5, and provided the air-fuel ratio [A/F] lies within this range, the fuel injection pulse width Ti is calculated using the long-term and short-term delay corrections Kl and Kh without modification by looking up a table based on the engine speed Ne and valve temperature Tb (steps 4, 6, 8, 9, 10). The values Kl and Kh are stored in a map of variables in a RAM, and are updated by learning. This data is backed up by a battery so that it is not erased even after the engine stops. Data which apply to standard gasoline are entered as initial values. The characteristics of the learned values of the long-term delay correction Kl and of the short-term delay correction Kh are shown in FIGS. 5 and 6. For the same engine speed Ne, the learned values of both of these corrections tend to increase as the valve temperature Tb falls, while for the same valve temperature Tb, the learned values tend to decrease as the engine speed Ne increases.

Figure 3:
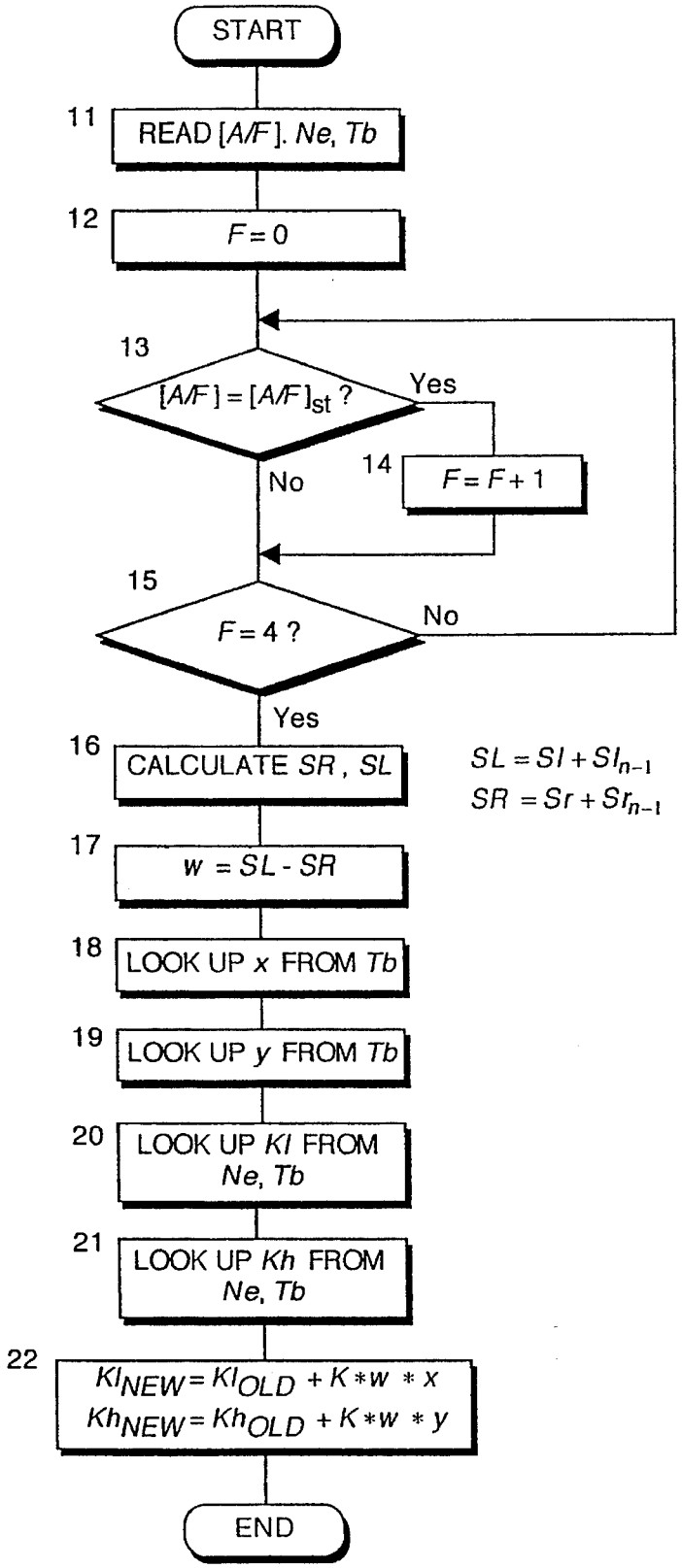
FIG. 3 is a flowchart describing an updating process of learned delay correction amounts Kl and Kh according to this invention.
Figure 4:
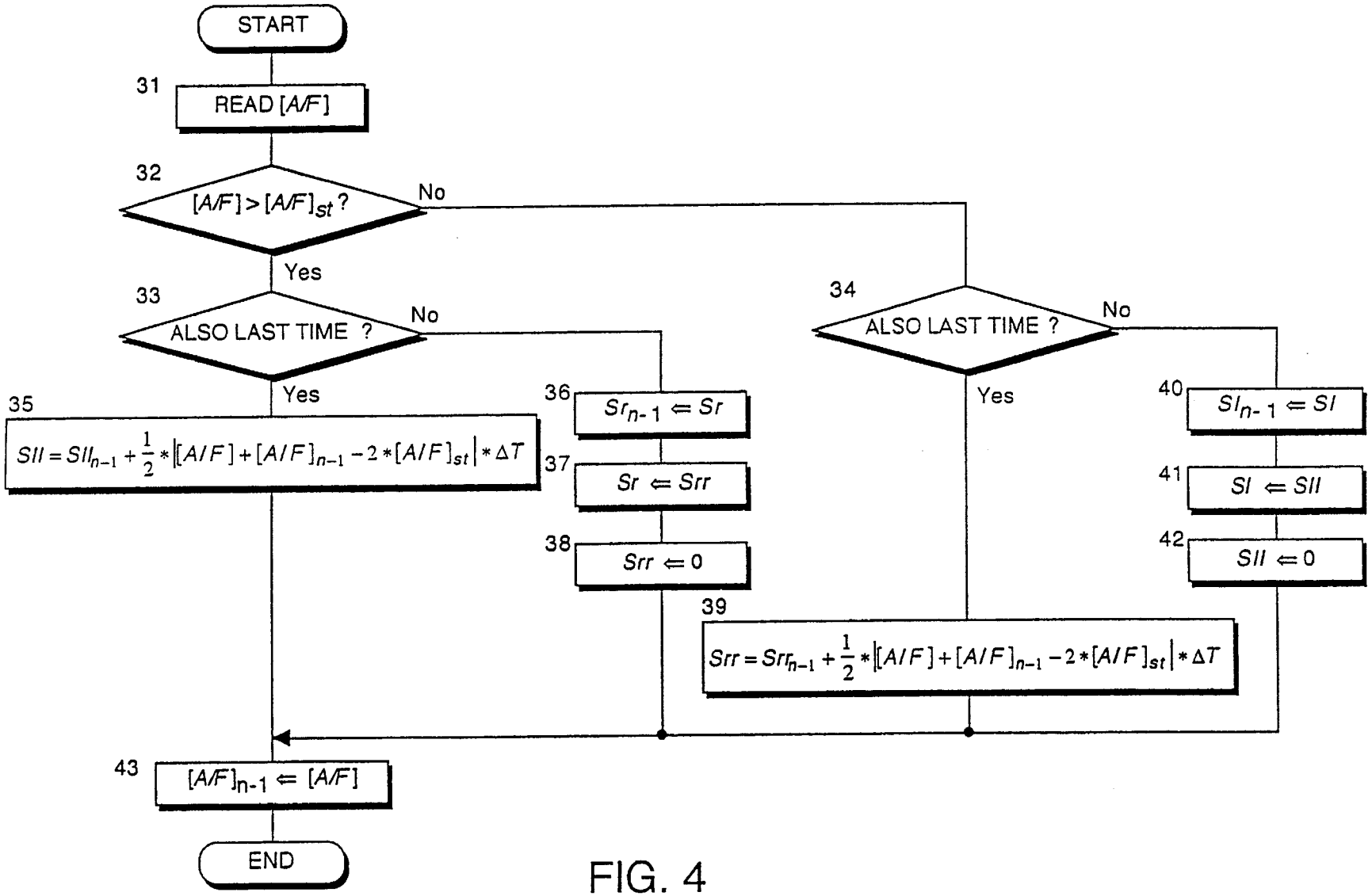
FIG. 4 is a flowchart describing a calculation process of lean region areas (Sl, $Sl_{n-1}$) and rich region areas (Sr, $Sr_{n-1}$) according to this invention.

When the air-fuel ratio [A/F] does not lie within the range defined by the rich limit $[A/F]_R$ and the lean limit $[A/F]_L$, the learned values Kl and Kh of the delay corrections are updated by the routine shown in FIG. 3 (step 7).

This routine is executed at regular intervals, for example 10 ms, independently of the routine shown in FIG. 2 until the end of processing.

First, the air-fuel ratio [A/F], the engine speed Ne and the valve temperature Tb are read (step 11), and a parameter F is set to an initial value of 0 (step 12).

Next, it is determined whether or not the air-fuel ratio [A/F] coincides with the theoretical air-fuel ratio [A/F]st which is the target air-fuel ratio (step 13). If it does the value of the parameter F is increased by 1 (step 14). It is then determined whether or not F has reached 4 (step 15). The aforementioned process is repeated until F=4.

Figure 11:
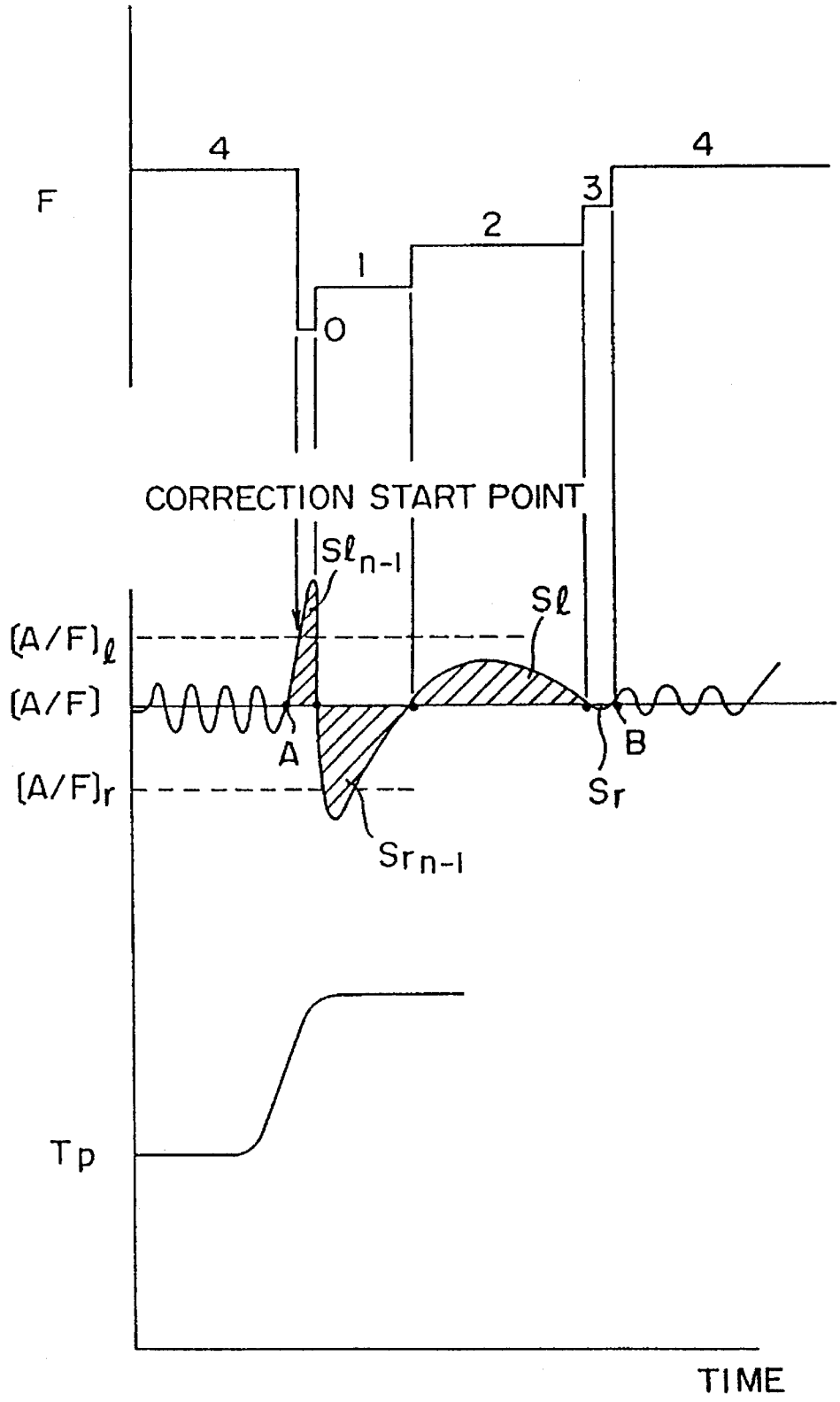
FIG. 11 is a diagram showing the variation of an air-fuel ratio [A/F] and a parameter F during acceleration according to this invention.

Describing the aforementioned process in terms of the variation of air-fuel ratio during acceleration, as shown in FIG. 11, the parameter F is first set equal to O when the updating routine begins. Subsequently, the value of F is updated by 1 each time the air-fuel ratio [A/F] cuts across the theoretical air-fuel ratio [A/F]st as shown by the black dots in the figure.

The value F=4 therefore shows that the air-fuel ratio [A/F] has already cut across the theoretical air-fuel ratio [A/F]st four times, and the control unit 21 then determines that the variation of air-fuel ratio due to transient conditions has finished. The interval from a point A where the theoretical air-fuel ratio is cut just prior to starting the updating routine, to a point B where the air-fuel ratio [A/F] cuts across the theoretical air-fuel ratio [A/F]st for the fourth time, is considered as an air-fuel fluctuation interval under transient conditions. The sum SL of the areas of the two regions in this interval when the air-fuel ratio [A/F] is lean, i.e. $Sl_{n-1}$ and Sl in FIG. 11, is found. Also, the sum SR of the areas of the regions in this interval when the air-fuel ratio [A/F] is rich, i.e. $Sr_{n-1}$ and Sr, is found. The difference between the total lean area SL and total rich area SR is referred to as the air-fuel ratio deviation w.

Due to delayed flow, a certain pattern is evident in the air-fuel ratio variation of FIG. 11 regardless of the degree of acceleration when the vehicle accelerates, or of differences in the nature of the fuel used. After the air-fuel ratio has shifted outside the tolerance region towards lean, it cuts across the theoretical air-fuel ratio as it moves toward rich, then as a reaction, again vacillates toward lean and rich, and finally converges to the theoretical air-fuel ratio. The aforesaid four regions which are shaded in the figure are therefore considered as an acceleration interval, and a shift of the air-fuel ratio towards lean or rich during this acceleration interval is taken as a basis for learning. During deceleration, the reverse pattern to that obtained during acceleration, i.e. the inverted waveform shown in FIG. 11, is obtained.

These areas are calculated at fixed intervals independently of the aforesaid processes of FIGS. 2 and 3 and regardless of whether the running conditions are steady state or transient. The calculation process is shown in FIG. 4.

In this calculation process, the air-fuel ratio [A/F] is read from the output of the air-fuel ratio sensor 12 (step 31), and is compared with the theoretical air-fuel ratio [A/F]st (step 32).

When lean conditions continue, an area Sll is calculated by the following equation (steps 32, 33, 35).

$$Sll = Sll_{n-1} + ½*|[A/F] + [A/F]_{n-1} - 2*[A/F]_{st}|*\Delta T$$

where, $Sll_{n-1}$=value of Sll on immediately preceding occasion $[A/F]_{n-1}$=value of [A/F] on immediately preceding occasion ΔT=control period (e.g. 2 ms)

When the air-fuel ratio cuts across the theoretical air-fuel ratio from lean to rich, the value in the parameter Sl is transferred to the parameter $Sl_{n-1}$ (steps 32, 34, 40), and the value of Sll is entered in the parameter Sl (step 41). Sll is then cleared (step 42).

On the other hand, when rich conditions continue, an area Srr is calculated by the following equation (steps 32, 34, 49).

$$Srr=Srr_{n-1}+½*|[A/F]+[A/F]_{n-1}-2*[A/F]_{st}|*\Delta T$$

where, $Srr_{n-1}$=value of Srr on immediately preceding occasion

When the air-fuel ratio cuts across the theoretical air-fuel ratio from rich to lean, the value in the parameter Sr is transferred to the parameter $Sr_{n-1}$ (steps 32, 33, 36), and the value of Srr is entered in the parameter Sr (step 37). Srr is then cleared (step 38).

Thus, for both lean and rich regions, the newest and second newest values of the area Sl (Sr) and $Sl_{n-1}$ ($Sr_{n-1}$) are always stored. Returning to the flowchart of FIG. 3, the lean area Sl and rich area Sr are found by the following equation from the stored areas when F=4 (steps 15, 16).

$$SL=Sl+Sl_{n-1}$$

$$SR=Sr+Sr_{n-1}$$

The difference between these areas is taken to be the air-fuel ratio deviation w (step 17). The delay correction is found by multiplying this deviation w by a constant K. K is a coefficient for matching the correction with the deviation w.

Figure 12:
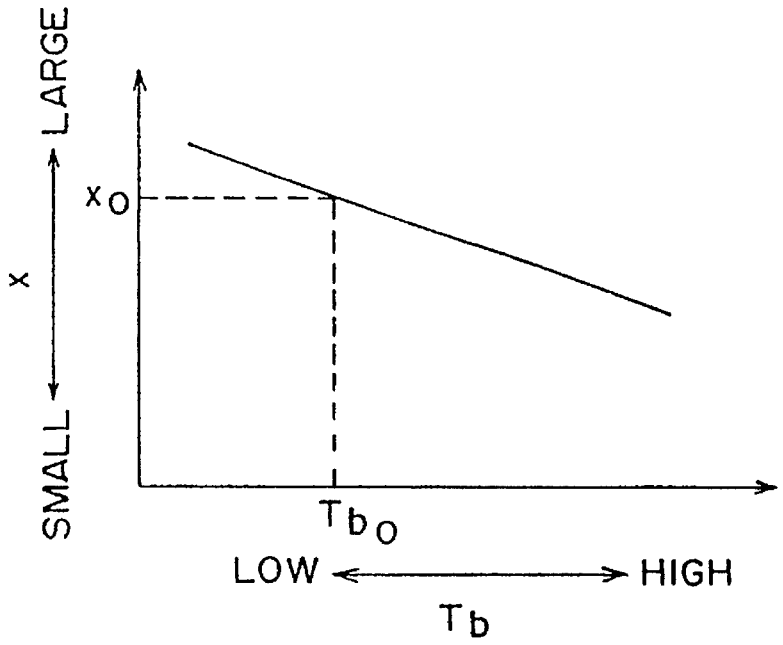
FIG. 12 is a graph showing the characteristics of a weighting coefficient x according to this invention.
Figure 13:
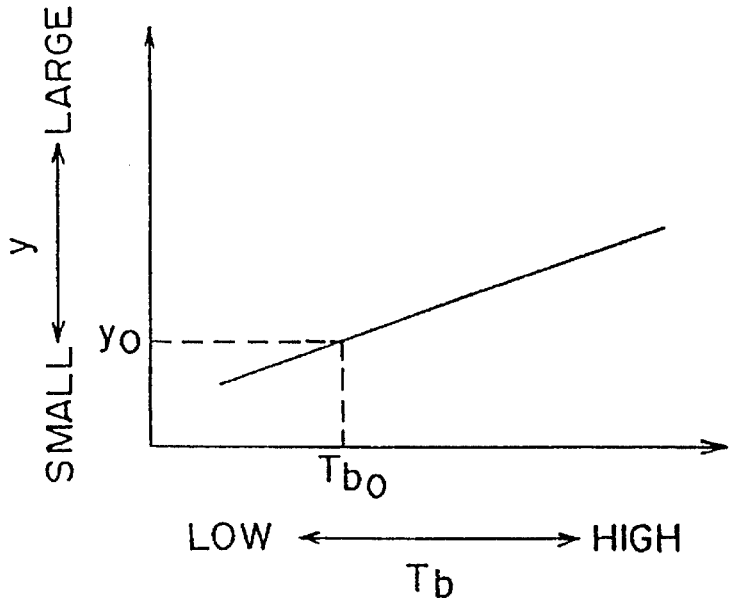
FIG. 13 is a graph showing the characteristics of a weighting coefficient y according to this invention.

Next, a map shown in FIG. 12 is looked up, and a weighting coefficient x, which determines the proportion of the long-term delay correction in the delay correction Kw is found from the valve temperature Tb (step 18). Likewise, a map shown in FIG. 13 is looked up, and a weighting coefficient y, which determines the proportion of the short-term delay correction in the delay correction Kw, is found from the valve temperature Tb (step 19). There is also a relation: y=1−x As shown in FIG. 12 and FIG. 13, the weighting coefficient x for the long-term delay coefficient increases the lower the valve temperature Tb, while the weighting coefficient y for the short-term delay coefficient decreases the lower the valve temperature Tb.

After looking up the existing learned values Kl and Kh from the aforesaid maps of FIGS. 5 and 6 (steps 20, 21), these values are shifted respectively to $Kl_{OLD}$ and $Kh_{OLD}$, and the values Kl and Kh are updated by the following equations.

$$Kl_{NEW}=Kl_{OLD}+K*w*x$$

$$Kh_{NEW}=Kh_{OLD}+K*w*y$$

where, $Kh_{NEW}$=long-term delay correction after updating $Kh_{NEW}$=short-term delay correction after updating $Kl_{OLD}$=long-term delay correction before updating $Kh_{OLD}$=short-term delay correction before updating $Kl_{OLD}$ and $Kh_{OLD}$ are map values found from the engine speed Ne and the valve temperature Tb when updating starts. $Kl_{NEW}$ and $Kh_{NEW}$ replace the old values and are stored in the same addresses.

Therefore, even if the valve temperature Tb varies for example during acceleration, the learned values are constantly updated as is appropriate according to the variation of the valve temperature Tb, and the air-fuel ratio is precisely controlled to the theoretical air-fuel ratio.

The weighting coefficients x and y are set such that the relation between Kl and Kh satisfies the following equation at an indefinite temperature T.

$$\frac{x(T)}{y(T)} > \frac{Kl(T)_{SET}}{Kh(T)_{SET}}$$

where, x(T)=value of x when Tb=T y(T)=value of y when Tb=T $Kl(T)_{SET}$=long-term delay correction amount initially set corresponding to standard gasoline. It is an average value for the case Tb=T $Kh(T)_{SET}$=short-term delay correction amount initially set corresponding to standard gasoline. It is an average value for the case Tb=T This shows that after learning and updating, the proportion of the long-term delay correction in the total correction is higher than before updating at the same temperature. The following relation always holds.

$$\frac{Kl_{NEW}}{Kh_{NEW}} > \frac{Kl_{OLD}}{Kh_{OLD}}$$

Figure 14:
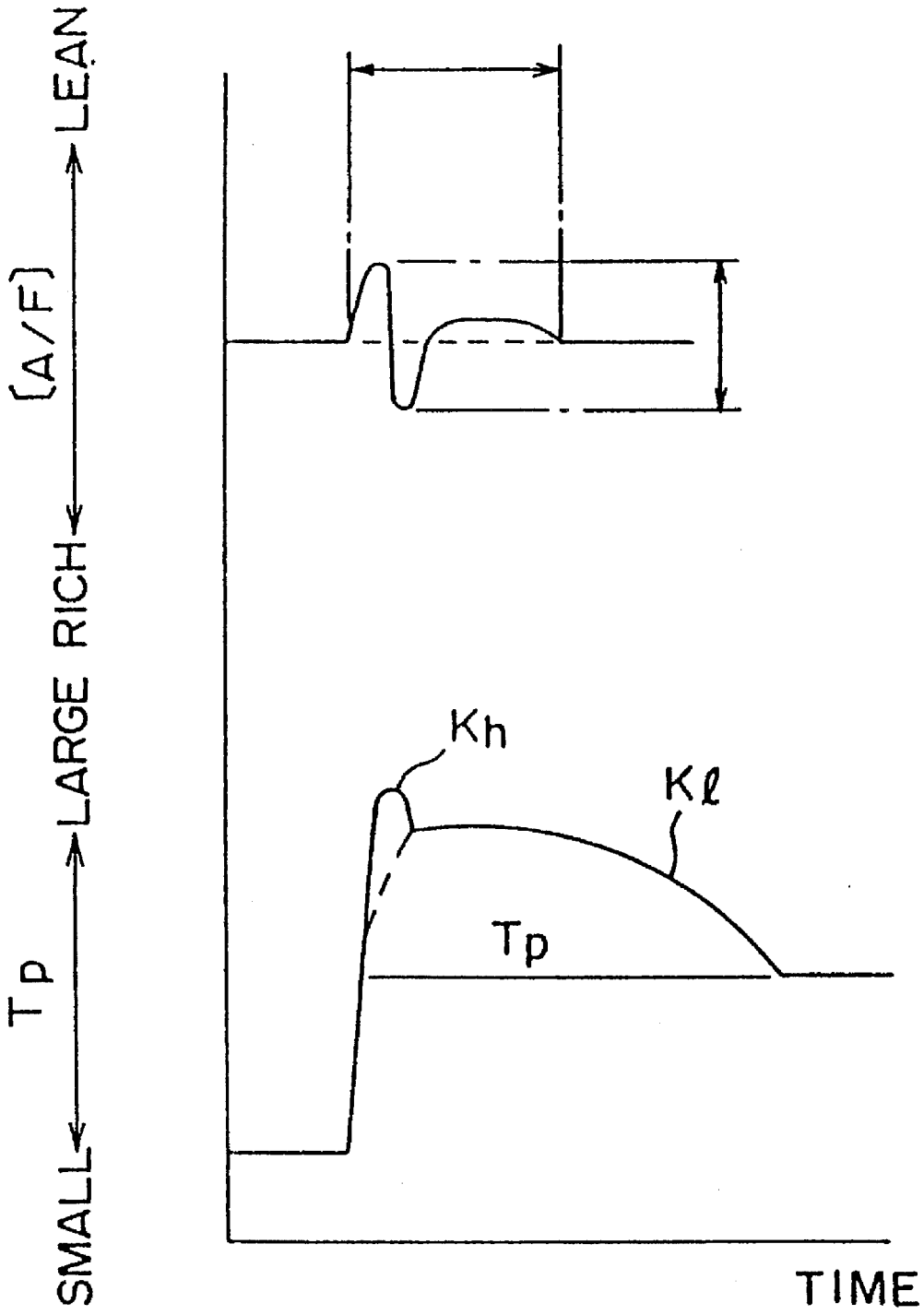
FIG. 14 is a graph showing the variation of the air-fuel ratio [A/F] and a basic fuel injection pulse width Tp during acceleration according to the first embodiment of this invention.

When heavy gasoline is used, due to its low volatility, the proportion of long-term delayed flow increases compared to the case of standard gasoline for the same valve temperature. If the learned values are updated using the weighting coefficients x, y for standard gasoline, the overshoot of the air-fuel ratio to rich during acceleration becomes larger. However, as the proportion of the long-term delay correction increases as a result of the aforementioned updating by learning process, the overshoot of the fuel ratio to rich is suppressed as shown in FIG. 14 even when there is a change-over from standard gasoline to heavy gasoline, so the air-fuel ratio is quickly stabilized.

Figure 7:
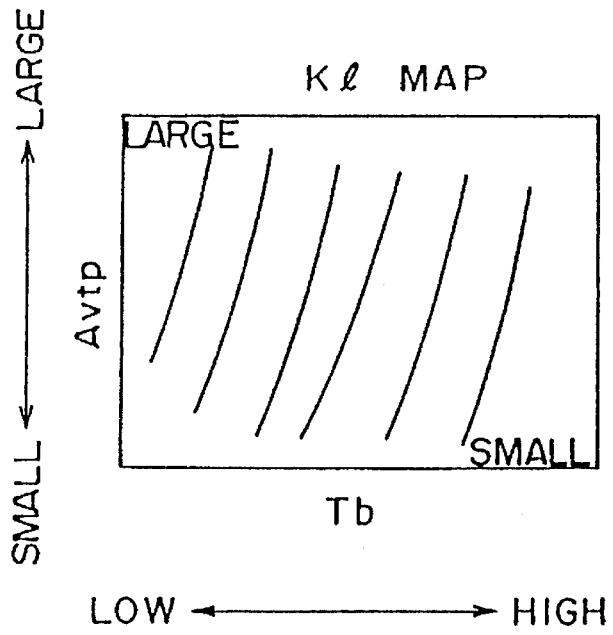
FIG. 7 is a map of the long-term delay correction amount Kl according to a second embodiment of this invention.
Figure 8:
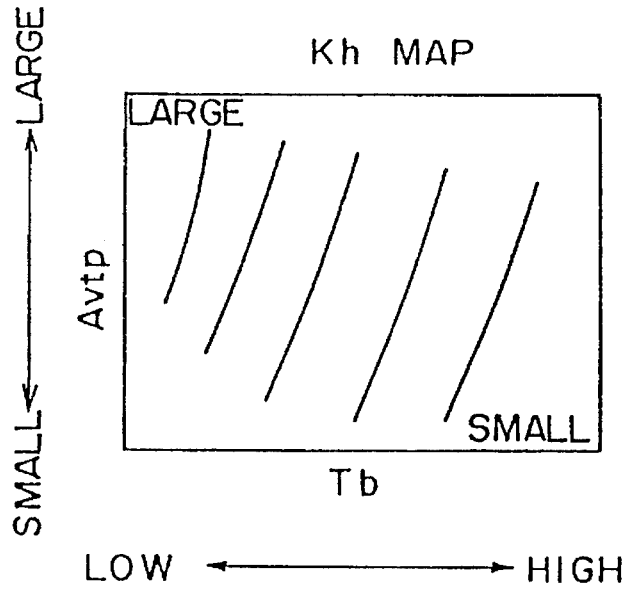
FIG. 8 is a map of the short-term delay correction amount Kh according to the second embodiment of this invention.

FIGS. 7 and 8 show maps of delay corrections Kl and Kh according to a second embodiment of this invention.

The maps of the correction amounts Kl and Kh are set up based on the cylinder air equivalent pulse width Avtp and the valve temperature Tb. In this case, Kh and Kl become larger as Avtp increases for the same valve temperature Tb.

Figure 9:
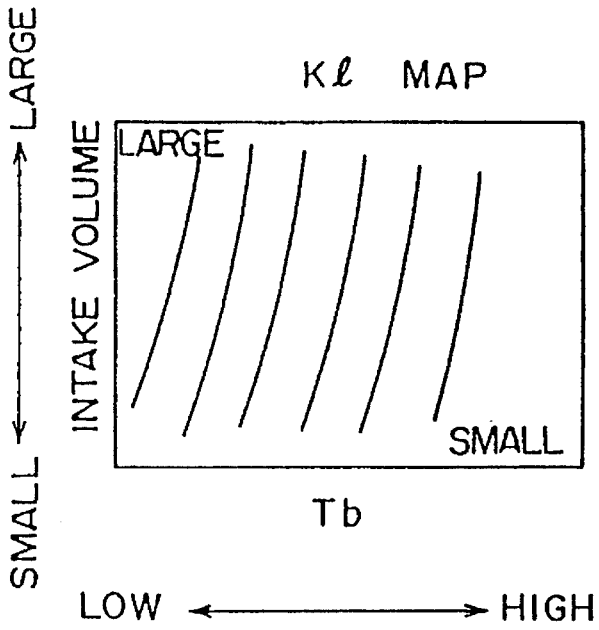
FIG. 9 is a map of the long-term delay correction amount Kl according to a third embodiment of this invention.
Figure 10:
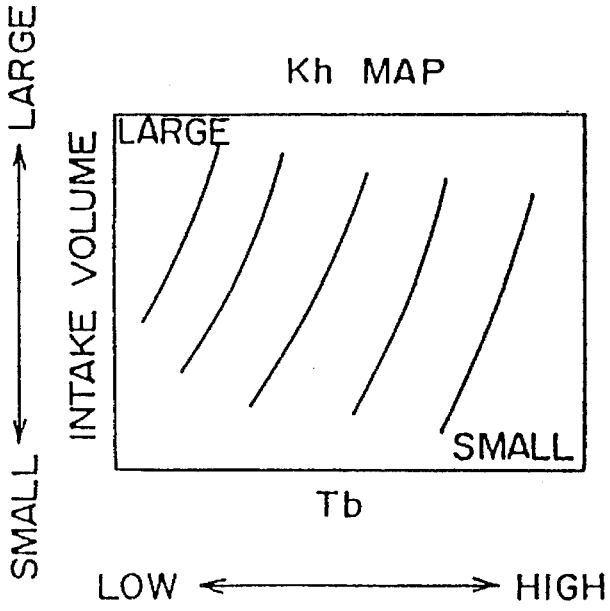
FIG. 10 is a map of the short-term delay correction amount Kh according to the third embodiment of this invention.

FIGS. 9 and 10 show maps of delay correction amounts Kl and Kh according to a third embodiment of the this invention. Here, the maps of the correction amounts Kl and Kh are set up based on the intake air volume Qa and the valve temperature Tb. In this case, Kh and Kl become larger as Qa increases for the same valve temperature Tb.

Avtp and Qa used in the second and third embodiments are both values which represent the load of the engine 1. Kl and Kh may should vary according to the valve temperature Tb, and to the engine speed or load.

Figure 15:
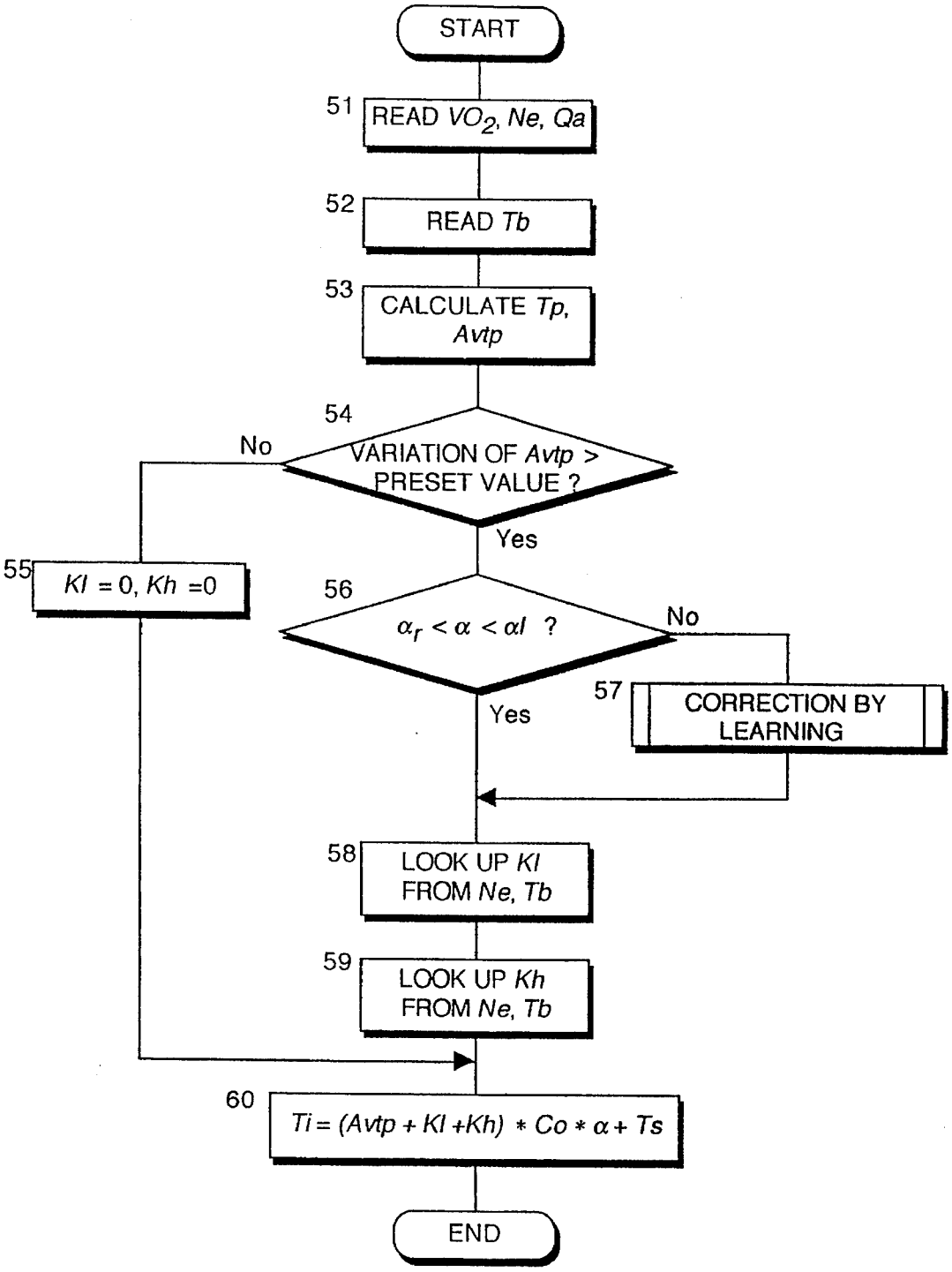
FIG. 15 is a flowchart describing a computation process of the fuel injection pulse width Ti according to a fourth embodiment of this invention.
Figure 16:
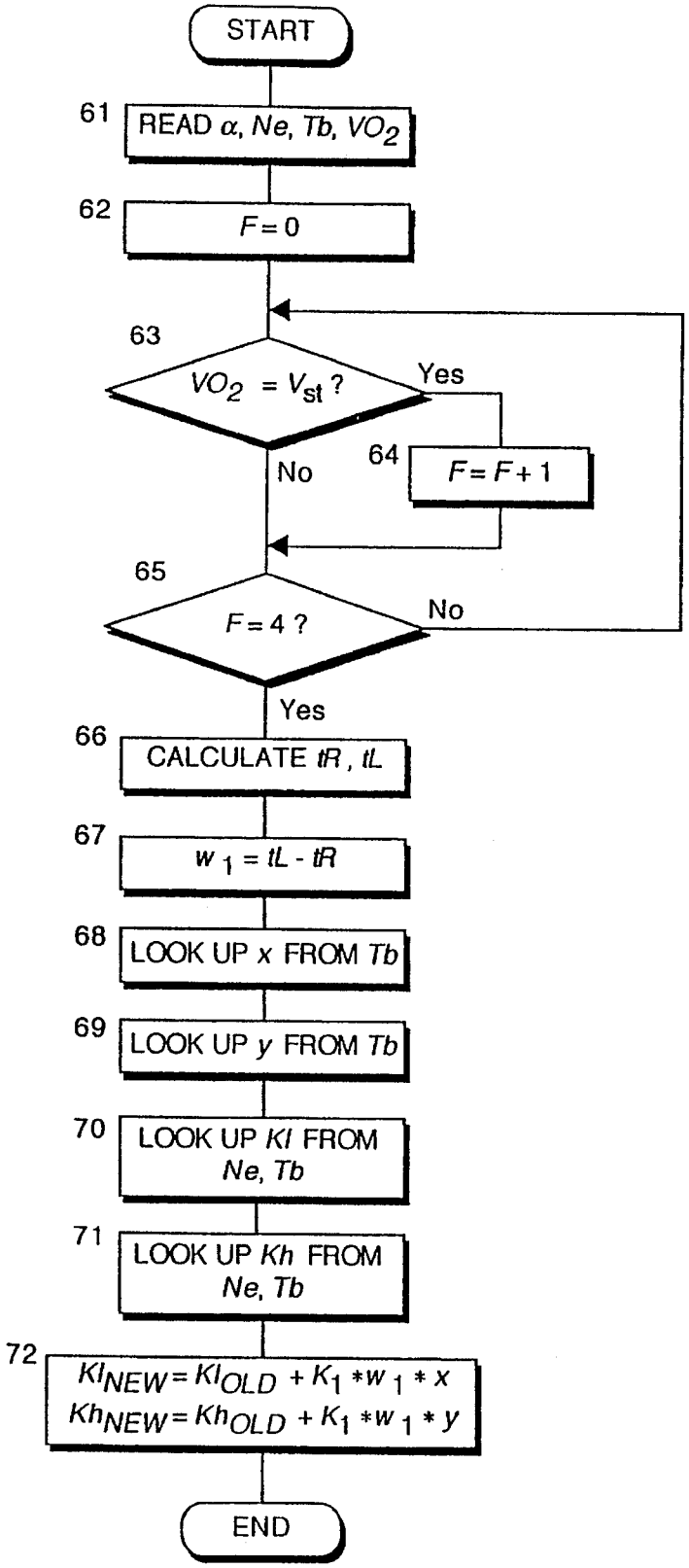
FIG. 16 is a flowchart describing an updating process of the learned values Kl and Kh according to the fourth embodiment of this invention.

Next, a fourth embodiment of this invention will be described with reference to FIGS. 15–17. According to this embodiment, an $O_2$ sensor whereof the output varies sharply when the air-fuel ratio fluctuates under lean or rich conditions about the theoretical air-fuel ratio, is used instead of the air-fuel ratio sensor 12 which detects the air-fuel ratio over a wide range. The flowchart of FIG. 15 corresponds to FIG. 2, and the flowchart of FIG. 16 corresponds to FIG. 3.

Figure 17:
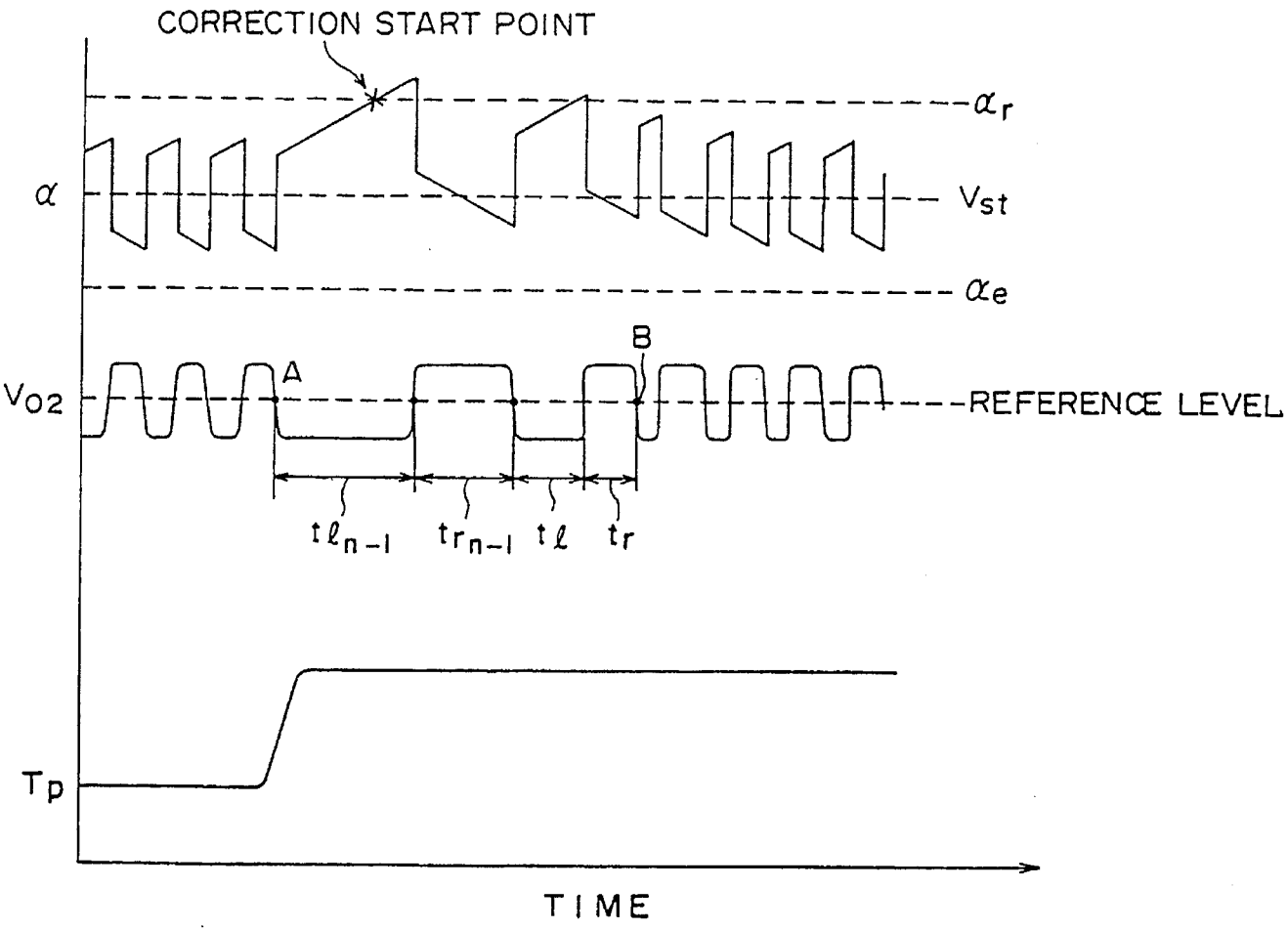
FIG. 17 is a waveform diagram describing lean times ($tl_{n-1}$, tl) and rich times ($tr_{n-1}$, tr) according to the fourth embodiment of this invention.

The output $VO_2$[V] of the $O_2$ sensor is approximately 1 V when the air-fuel ratio is rich, and approximately 0 V when the air-fuel ratio is lean, and from this output, it is possible only to determine whether the air-fuel ratio is rich or lean. This embodiment therefore differs from the aforesaid three embodiments insofar as concerns the following three points.

i) To determine whether or not the air-fuel ratio is within tolerance limits, it is determined whether or not the air-fuel ratio feedback coefficient α lies between a rich limit αr (e.g. 90%) and a lean limit αl (e.g. 110%) (step 56).

ii) To determine whether or not the air-fuel ratio coincides with the theoretical air-fuel ratio, it is determined whether or not the output $VO_2$ of the $O_2$ sensor is identical with a slice level Vst (e.g. 0.5 V) corresponding to the theoretical air-fuel ratio (steps 61, 63).

iii) Instead of using the areas of the lean and rich regions, a total lean time tL and a total rich time tR are computed in a transient interval, i.e. an interval A–B shown in FIG. 17 wherein the air-fuel feedback coefficient α fluctuates through two cycles (step 66)

$$tL=tl_{n-1}+tl$$

$$iR=tr_{n-1}+tr$$

These differences are set equal to an air-fuel deviation $w_1$ (step 67), and the two learned values are updated by the following equations (steps 68–72)

$$Kl_{NEW}=KL_{OLD}+K_1*w_1*x$$

$$Kh_{NEW}=Kh_{OLD}K_1*w_1*y$$

wherein, $K_1$=coefficient for matching the air-fuel ratio deviation with the delay correction The lean times ($tl_{n-1}$,tl) and rich times ($tr_{n-1}$,tr) are constantly measured and updated as in the case of the lean area ($Sl_{n-1}$,Sl) and the rich area ($Sr_{n-1}$,Sr) of the first embodiment.

This embodiment uses the $O_2$ sensor, which is more economical than the air-fuel ratio sensor. Although the precision is slightly lower than that of the other embodiments, the system can be implemented at a lower cost.

The embodiments of this invention in which an exclusive property or privilege is claimed are defined as follows:

1. A fuel injection controller in an engine comprising a cylinder, an intake passage provided with a valve that aspirates air into said cylinder, a throttle for regulating the flowrate in said passage, and an injector provided between said throttle and said valve for injecting fuel into said passage according to an input signal, said controller comprising:

means for detecting an engine running condition, said detected engine running condition being one of plurality of possible engine running condition, means for detecting a temperature of a part of said passage to which injected fuel adheres, said detected temperature being one of a plurality of possible temperature, a processor programmed to perform the following functions, a) calculating a basic fuel injection amount based on said detected engine running condition, b) computing and storing short-term delay correction amounts respectively corresponding to said plurality of possible engine running conditions and said plurality of possible temperatures of said part, said short-term delay correction amounts compensating for a delayed flow in said passage having a time constant greater than a predetermined value, c) computing and storing long-term delay correction amounts respectively corresponding to a said plurality of possible engine running conditions and said plurality of possible temperatures of said part, said long-term delay correction amounts compensating for a delayed flow in said passage having a time constant less than said predetermined value, d) reading a short-term delay correction amount from said stored short-term delay correction amounts which corresponds to said detected engine running condition and said detected temperature, e) reading a long-term delay correction amount from said stored long-term delay correction amounts which corresponds to said detected engine running condition and said detected temperature, and f) correcting said basic fuel injection amount by said short-term and long-term read correction amounts, and means for applying a signal corresponding to said corresponding fuel injection amount to said injector. correction amount and to an updating amount of said long-term delay correction amount based on said factor.

2. A fuel injection controller as defined in claim 1, wherein said basic updating amount calculating means comprises means for respectively calculating areas of lean and rich regions of the air-fuel ration with respect to said target value over a predetermined time interval, each of said areas being equal to the product of said difference and the elapsed time, means for calculating a difference of said areas, and means for calculating said basic updating amount based on said difference of areas.

3. A fuel injection controller as defined in claim 1, wherein said basic updating amount calculating means comprises means for respectively accumulating times for for which the detected air-fuel ratio is lean and rich with respect to said target value over a predetermined time interval, means for calculating a difference of said times, and means for calculating said basic updating amount based on said difference of times.

4. A fuel injection controller as defined in claim 1, wherein said updating means comprises means for determining a total updating amounts which is directly proportional to said basic updating amount, means for determining a proportion assignment factor of said total updating amount based on the temperature of said part, and means for allocating said total updating amount to an updating amount of said short-term delay correction amount and to an updating amount of said long-term delay correction amount based on said factor.

5. A fuel injection controller as defined in claim 4, wherein said factor determine means decreases the proportion assigned to said short-term delay correction updating amount, and increases the proportion assigned to said long-term delay correction updating amount, the lower the temperature of said part.

6. A fuel injection controller as defined in claim 4, wherein said factor determining means further comprises means for forcing the proportion assigned to said long-term delay correction updating amount to always exceed a value preset according to the temperature of said part.

7. A fuel injection controller as defined in claim 1, wherein said temperature detecting means comprises means for detecting a temperature of said valve.

8. A fuel injection controller as defined in claim 1, further comprising:

means for detecting an air-fuel ratio in said cylinder, wherein said processor is further programmed to perform the following functions, g) calculating basic updating amount based on a difference between said detected air-fuel ratio and a preset target value of said air-fuel ratio, and h) updating said short-term and long-term delay correction amounts stored in said processor based on said based updating amount and said detected temperature.

* * * * *